US007063344B2

(12) United States Patent
Pichette

(10) Patent No.: US 7,063,344 B2
(45) Date of Patent: Jun. 20, 2006

(54) AUXILIARY WHEELCHAIR

(76) Inventor: Guy Pichette, 3755, 88th Street, St-Georges de Beauce, QBC (CA) G5Y 5C2

( * ) Notice: Subject to any disclaimer, the term of this patent is extended or adjusted under 35 U.S.C. 154(b) by 148 days.

(21) Appl. No.: 10/434,070

(22) Filed: May 9, 2003

(65) Prior Publication Data

US 2004/0222603 A1 Nov. 11, 2004

(51) Int. Cl.
*A61G 5/00* (2006.01)

(52) U.S. Cl. ..... 280/304.1; 297/DIG. 4

(58) Field of Classification Search ..... 280/657, 280/43, 43.17, 43.22, 87.01, 47.38, 47.41, 280/304.1; 297/DIG. 4, 256.1, 256.11, 232, 297/241, 42, 44

See application file for complete search history.

(56) References Cited

U.S. PATENT DOCUMENTS

| | | | | | |
|---|---|---|---|---|---|
| 2,818,910 | A | * | 1/1958 | Hawkins | 297/45 |
| 4,240,169 | A | * | 12/1980 | Roos | 5/613 |
| 4,684,149 | A | * | 8/1987 | Meyer | 280/650 |
| 4,728,119 | A | * | 3/1988 | Sigafoo | 280/657 |
| 4,737,997 | A | * | 4/1988 | Lamson | 5/87.1 |
| 4,874,203 | A | * | 10/1989 | Henley | 297/250.1 |
| 4,908,890 | A | | 3/1990 | Beckman et al. | |
| 4,955,624 | A | * | 9/1990 | Jeun-Long | 280/42 |
| 5,076,390 | A | * | 12/1991 | Haskins | 280/250.1 |
| 5,207,286 | A | * | 5/1993 | McKelvey | 180/13 |
| 5,207,549 | A | | 5/1993 | Riva | |
| 5,255,934 | A | | 10/1993 | Wilson | |
| 5,419,571 | A | * | 5/1995 | Vaughan | 280/250.1 |
| 5,704,439 | A | | 1/1998 | Kitahama et al. | |
| 6,036,216 | A | | 3/2000 | Osborn | |
| 6,588,792 | B1 | * | 7/2003 | Koerlin et al. | 280/650 |
| 6,676,140 | B1 | * | 1/2004 | Gondobintoro | 280/33.993 |
| 2001/0011805 | A1 | | 8/2001 | Kueschall | |

* cited by examiner

*Primary Examiner*—Frank Vanaman
(74) *Attorney, Agent, or Firm*—Protections Equinox Int'l; Franz Bousang, Patent Agent

(57) ABSTRACT

Auxiliary wheelchair for disposing on a primary wheelchair. The auxiliary wheelchair includes first and second frame sections that are telescopically connected together. The second frame section is actuatable relative to the first frame section from a first support configuration to a second support configuration. The first support configuration is when the first frame section and the second frame section are spaced apart and a primary wheelchair seat supports the first and second frame sections. The second support configuration is when the second frame section is in contact engagement with a support surface and the first frame section is in contact engagement with the primary wheelchair seat so that the auxiliary wheelchair is supported by the primary wheelchair seat and the support surface.

42 Claims, 9 Drawing Sheets

AUXILIARY WHEELCHAIR

FIELD OF THE INVENTION

The present invention concerns wheelchairs, more particularly to an auxiliary wheelchair for disposing on the wheelchair.

BACKGROUND OF THE INVENTION

Wheelchairs are well known in the medical field for giving mobility to disabled persons. Conventionally, wheelchairs include a frame to which wheels are attached, a seat and a back support. The conventional wheelchair has two relatively large rear wheels and two smaller front wheels. The two front wheels are usually pivotally mounted so that the wheelchair can be turned or steered by independent rotation of the two large rear wheels. Typically, the two larger rear wheels are turned by manual manipulation, and for this purpose, an outer concentric rim is normally mounted on the wheel and the concentric rim is turned by the hand to drive and steer the wheelchair. The wheels are generally large enough to allow the disabled person to rotate them by hand and to maneuver the wheelchair to avoid obstacles. Wheelchairs often have handles extending from the rear to allow a second person to push the wheelchair. Wheelchairs do however suffer from a number of significant drawbacks and disadvantages. Their inherent bulk makes it difficult for the wheelchair to enter limited spaces, such as lavatory cubicles. Another commonly encountered problem is that the wheelchair does not allow for easy transfer of the disabled person from the wheelchair to another surface, such as a bed.

U.S. Pat. No. 4,737,997, issued on Apr. 19, 1988, to Lamson discloses a patient transfer device that includes an auxiliary frame, for use with a wheelchair, consisting of a separatable seat and a pivoted frame with a frame adjuster. Disadvantageously, the device may be difficult for a disabled person to maneuver away from the wheelchair and may be unstable since the patient's weight is disposed at the rear of the device. Furthermore, the hinging connection and the frame adjuster only appears to allow for limited movement of the frame. Also, the device appears to be useful for only one size of wheelchair.

Thus there is a need for an auxiliary wheelchair frame that is easy to operate, is adaptable to wheelchairs of different sizes, and which allows a disabled person easy access to areas of limited size.

SUMMARY OF THE INVENTION

The inventor has made a new and unexpected discovery that an auxiliary wheelchair can be detached from a primary wheelchair by using a telescoping auxiliary wheelchair frame that is operable by a hand-operated actuator. Advantageously, this simple mechanism allows a disabled person, in a limited space, to easily disengage the auxiliary wheelchair from a primary wheelchair seat such that the auxiliary frame can then carry the disabled person into an area where access of a bulky primary wheelchair would be limited. Furthermore, the auxiliary wheelchair is easily adaptable to existing wheelchair, with only minor modifications of the frame width necessary to allow the auxiliary wheelchair to be attached thereto.

In a first aspect of the invention, there is provided an auxiliary wheelchair for disposing on a primary wheelchair, said auxiliary wheelchair comprising: first and second frame sections; frame section connector for telescopically movably connecting said first frame section and said second frame section relative to one another longitudinally along a connecting axis therefor, said second frame section being actuatable for longitudinal movement along said connecting axis relative to said first frame section from a first support configuration to a second support configuration; said first support configuration being when said first frame section is in contact engagement with a primary wheelchair seat to support said first and second frame sections and said second frame section is entirely spaced apart from said primary wheelchair seat and a support surface; said second support configuration being when said second frame section is in contact engagement with said support surface and said first frame section is in contact engagement with said primary wheelchair seat so that said auxiliary wheelchair is supported by said primary wheelchair seat and said support surface.

In another embodiment, the second frame section is actuatable for longitudinal movement along said connecting axis relative to said first frame section from said second support configuration to a third support configuration; the third support configuration being when said first frame section is spaced apart from said primary wheelchair seat, and said support surface supports said first and second frame sections.

Typically, the first frame section includes two side sections movably connected to each other. Each side section includes: a generally horizontal upper portion; a front portion; and an intermediate portion interconnecting said upper portion and said front portion. The intermediate portion is curved.

Typically, the front portion includes first and second longitudinal body portions, said first longitudinal body portion having a bore extending longitudinally axially along said connecting axis therein and sized to longitudinally axially and slidably receive said second longitudinal body portion therein.

Typically, the second longitudinal body portion is connected to a front wheel plate and extends longitudinally upwardly therefrom along said connecting axis towards said first longitudinal body portion, said front wheel plate being connected to said second frame section.

Typically, the second frame section includes: first and second central sections substantially adjacent to each other and extending along an edge thereof, each of said central sections being spread apart at a front and rear end section; and a rear end connector section connected to each rear end section of said central section.

Typically, a rear wheel plate is connected to said rear end section and said front wheel plate is connected to said front end section. A steerable wheel is attached to each of said front wheel plate. The rear wheel plate is a generally V-shaped plate having a plate outer face.

Typically, a rear wheel is attached to said V-shaped plate outer face for rotation relative thereto, said rear wheel being angled laterally away from said rear end section.

In another embodiment, each side section includes first and second connectors connected to said upper portions, said first and second connectors defining a seating section therebetween. Each side section further includes a third connector connected to said front portion. The seating section includes a plurality of spaced apart support panels each having a panel end connected respectively to said first and second connectors. The seating section is sized to receive a cushion thereon.

In another embodiment, an actuator is connected to each of said first and second longitudinal body portions for longitudinally axially displacing said second longitudinal body portion along said connecting axis relative to said first longitudinal body portion within said axial bore. The actuator is a hand-operated hydraulic actuator.

In another embodiment, the first and second connectors each includes a width adjustment member for increasing or decreasing the width of said auxiliary wheelchair so as to accommodate primary wheelchairs of different sizes.

Typically, the width adjustment member comprises: a separatable tube portion located in each of said connectors; and an adjuster rod slidably axially mounted in each of said separatable tube portions to allow said separatable tube portions to move axially towards and away from each other. The width adjuster member is located centrally in each of said first and second connectors. The width adjuster member is releasably lockable.

In a second aspect of the present invention, there is provided a wheelchair, comprising a primary wheelchair seat for releasably supporting thereon an auxiliary wheelchair, said auxiliary wheelchair having first and second frame sections; frame section connector for telescopically movably connecting said first frame section and said second frame section relative to one another longitudinally along a connecting axis therefor, said second frame section being actuatable for longitudinal movement along said connecting axis relative to said first frame section from a first support configuration to a second support configuration; said first support configuration being when said first frame section is in contact engagement with said primary wheelchair seat to support said first and second frame sections and said second frame section is entirely spaced apart from said primary wheelchair seat and a support surface; said second support configuration being when said second frame section is in contact engagement with said support surface and said first frame section is in contact engagement with said primary wheelchair seat so that said auxiliary wheelchair is supported by said primary wheelchair seat and said support surface.

In a third aspect of the present invention, there is provided a method of disengaging an auxiliary wheelchair from a primary wheel chair, said method comprising: moving an auxiliary wheelchair first frame section relative to an auxiliary wheelchair second frame section from a first support configuration to a second support configuration, said first support configuration being when said first frame section and said second frame section are spaced apart from each other and a primary wheelchair seat supports said first and second frame sections; said second support configuration being when said second frame section is in contact engagement with a support surface and said first frame section is in contact engagement with said primary wheelchair seat so that said auxiliary wheelchair is supported by said primary wheelchair seat and said support surface.

BRIEF DESCRIPTION OF THE FIGURES

Further aspects and advantages of the present invention will become better understood with reference to the description in association with the following Figures, wherein.

DETAILED DESCRIPTION OF THE PREFERRED EMBODIMENTS

Figure 1:
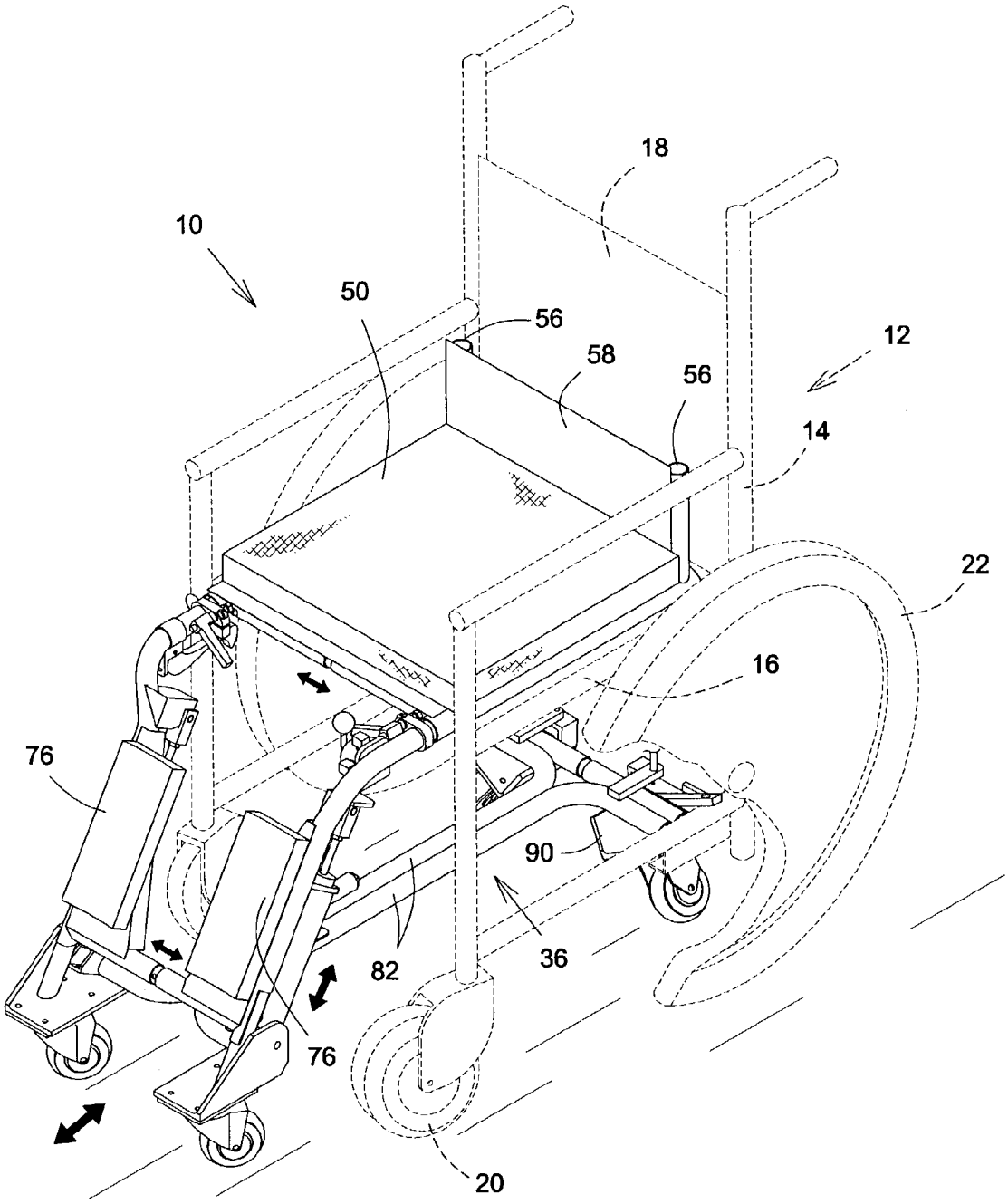
FIG. 1 is a perspective view of an embodiment of an auxiliary wheelchair mounted on a primary wheelchair.
Figure 2:
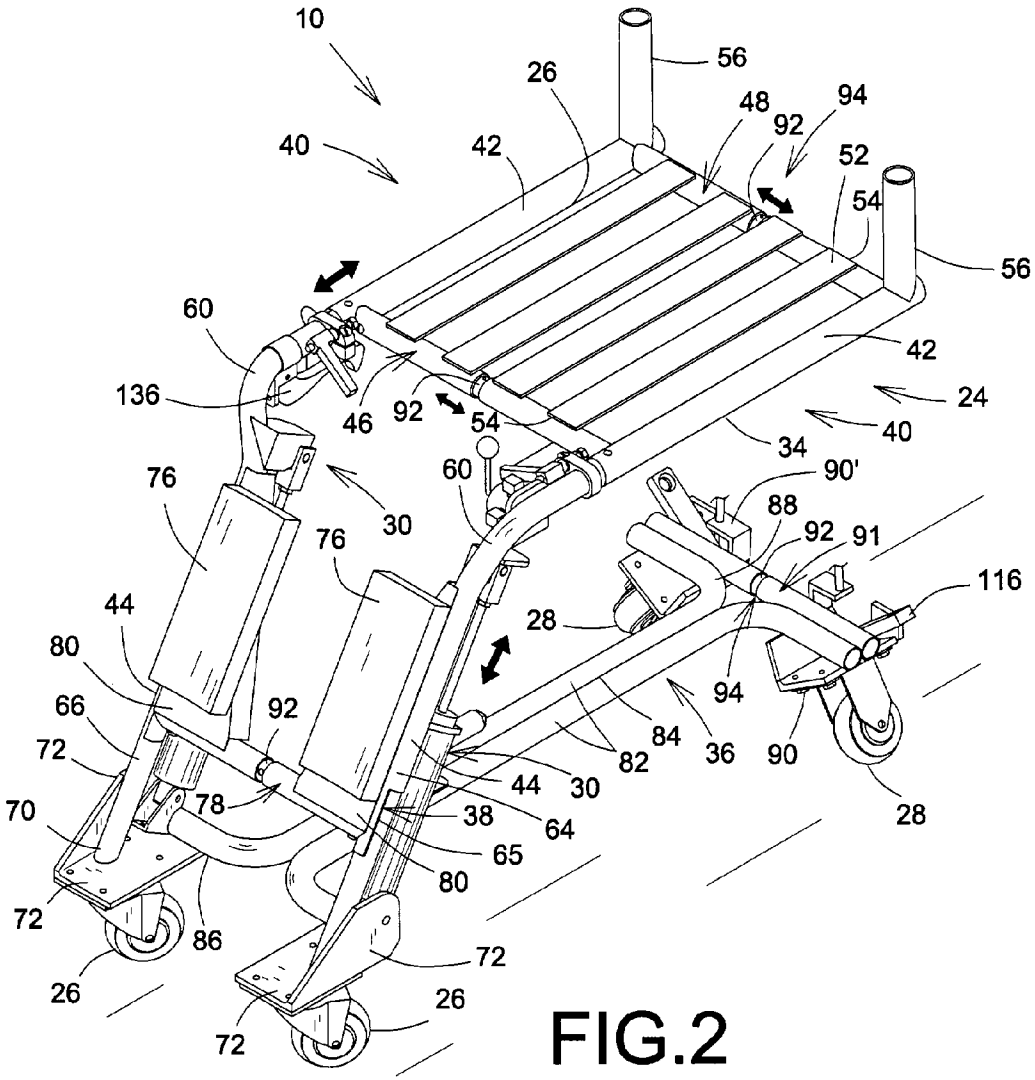
FIG. 2 is a perspective view of the auxiliary wheelchair of FIG. 1 completely disengaged from the primary wheelchair.

FIGS. 1 and 2 show an embodiment of an auxiliary wheelchair 10 of the present invention disposed on a primary wheelchair 12. Conventionally, the primary wheelchair 12 includes a primary wheel chair frame 14, a seat 16, a backrest 18, two front wheels 20 and two rear wheels 22. Generally, the auxiliary wheelchair 10 of the present invention includes an auxiliary frame 24, a seating portion 26, two front wheels 26, two rear wheels 28, and two hand-operated actuators 30.

Figure 13:
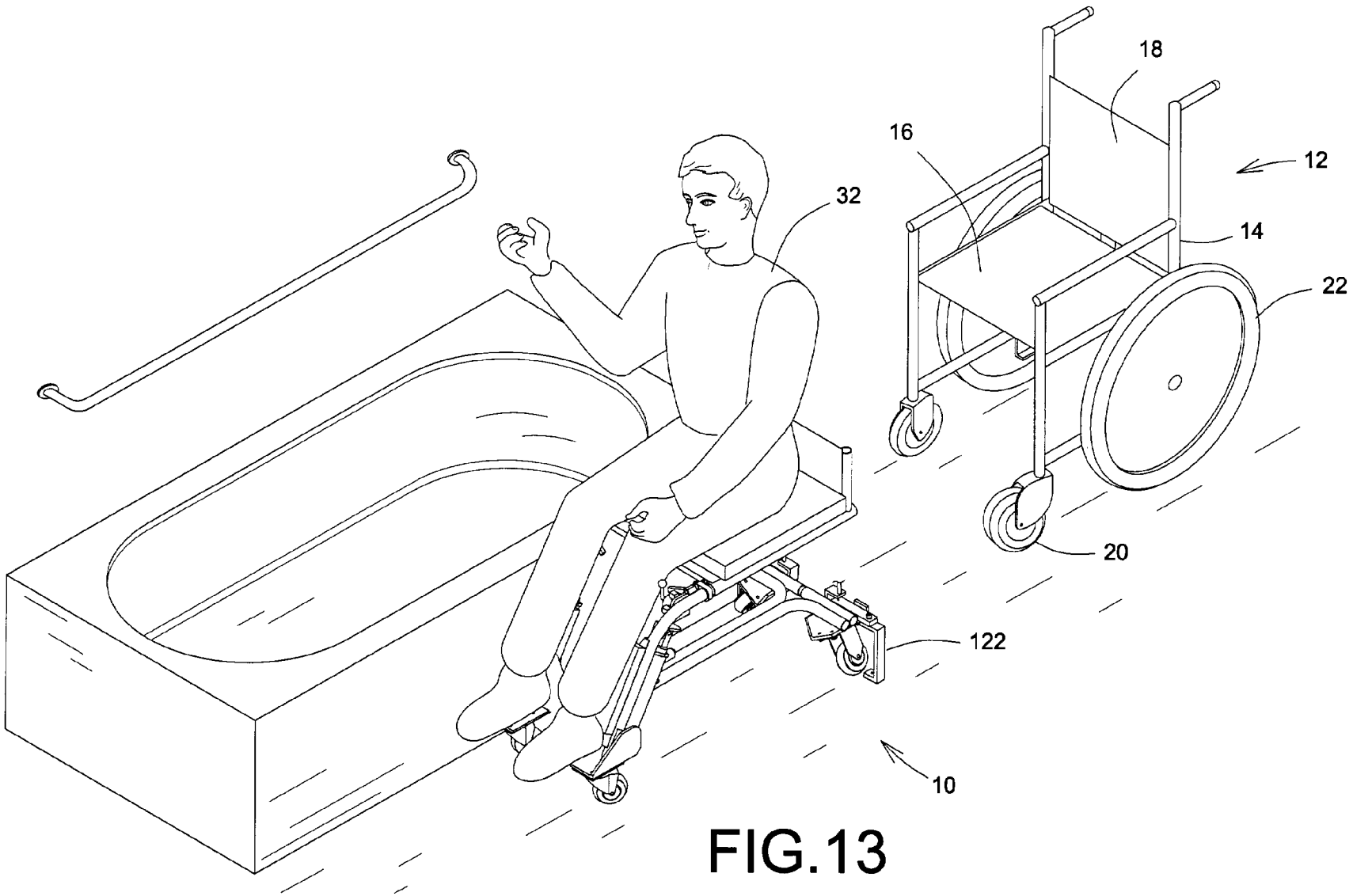
FIG. 13 is a perspective view the auxiliary wheelchair of FIG. 1 with a user adjacent a bathtub.

As best illustrated in FIGS. 2 and 13, the auxiliary wheelchair 10 is separable from the primary wheelchair 12 to allow a disabled person 32 easy access to areas such as adjacent a bathtub or the like. The wheels 20 are steerable to allow the disabled person to maneuver the auxiliary wheelchair 10 in more confined areas such as a toilet cubicle where the bulky primary wheelchair would have limited access. Referring to FIG. 2, the auxiliary frame 10 includes a first (upper) 34 and a second (lower) frame section 36 and a frame section connector 38. The auxiliary frame 10 is generally constructed of lightweight yet durable materials such as tubular aluminum or stainless steel. The upper frame section 34 includes two side sections 40, each side section 40 includes a horizontal portion 42 and a front portion 44. The horizontal portions 42 are connected together by two cross connector tubes, one at the front 46 and one at the rear 48, which together with the horizontal portions 42 form the 26 generally square seating area 26. The seating area 26 is sufficiently sized to allow a cushion 50 to be attached thereto. The cushion 50 may be attached by Velcro™, or some other temporary attachment means known to those skilled in the art, to allow the user to remove the cushion 50 for cleaning.

In this embodiment, a number of support panels 52 are connected at their ends 54 to each of the cross connector tubes 46, 48 and provide a surface to which the cushion 50 may be rested upon. The support panels 52 are spaced apart from each other to provide air circulation around the seating area 26 and prevent excessive mass at the upper frame section 34 such that the center of gravity of the overall auxiliary wheelchair 10 is maintained as low as possible to avoid possible injuries to the user from tilting over of the auxiliary wheelchair 10. The support panels 52 are typically constructed of a rigid material, but could also be of a resilient material such as rubber or any tension resistant woven cloth. The seating area 26 may also be a single sheet of material having a gap between two central portions. The rear cross tubes 46, 48 include two generally vertical tubes 56 to which a back support 58 is connected. The back support 58 may be made of material known to those skilled in the art and are preferably made out of the same resilient material as the support panels 52. The back support 58 and the support panels 52 could eventually be made out as a single piece of material.

The side sections 40 include an intermediate portion 60, which is curved down towards the ground and locates the front portions 44 away from the front of the primary wheelchair 12. The intermediate portion 60 interconnects the horizontal portions 42 and the front portions 44.

Figure 3A:
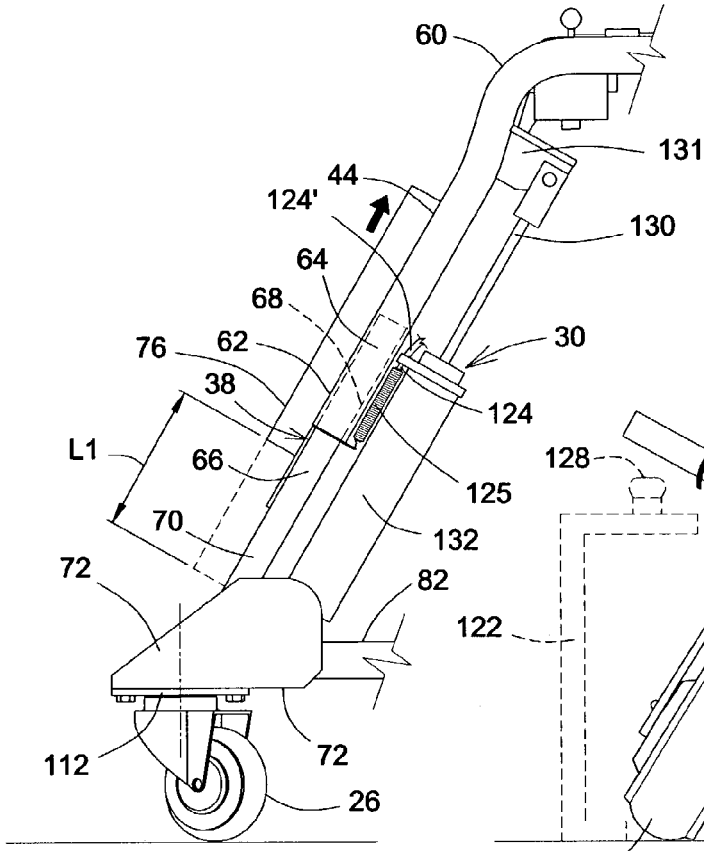
FIG. 3*a* is a partial side view of a front section of the auxiliary wheelchair showing an extended telescoping frame section connector.
Figure 4A:
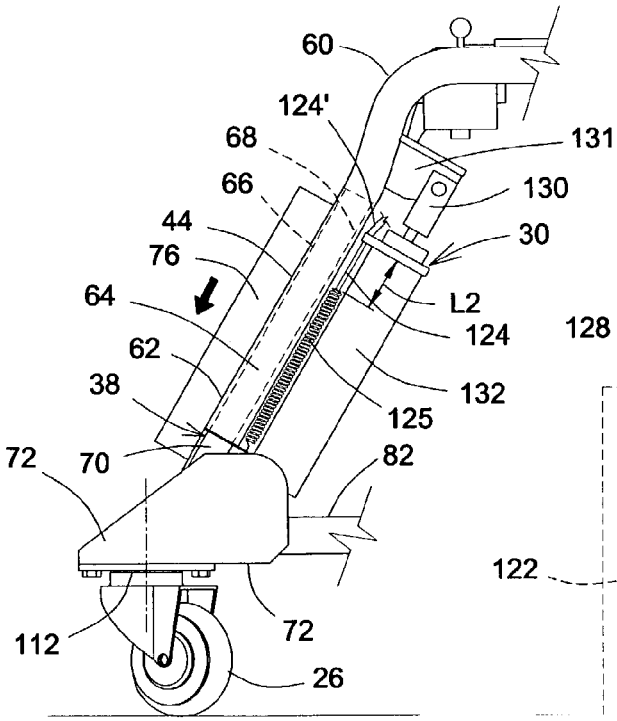
FIG. 4*a* is a partial side view of the front portion of the auxiliary wheelchair showing a retracted telescoping frame section connector.

As best Illustrated in FIGS. 3*a* and 4*a*, located towards a lower end 62 of each of the front portions 44 is the frame section connector 38. The frame section connector 38 includes a first longitudinal body portion 64 and a second longitudinal body portion 66. The first longitudinal body portion 64 has an axial bore 68 located therein. The axial bore 68 is sized to allow the second longitudinal body portion 66 to typically axially slide therein in a conventional telescoping manner when the actuators 30 are activated, as will be described below. A lower end 70 of the second longitudinal body portion 66 is connected to a front wheel plate 72. The front wheel plate 72 is also connected to the lower frame section 36. The second longitudinal body portion 66 extends generally upwardly and away from the lower frame section 36. As shown in FIG. 2, the first longitudinal body portions 64 have a cutout 65 at the lower end to clear the respective front wheel plate 72.

As best illustrated in FIG. 2, two leg rest panels 76, typically cushioned, are connected to each of the front portions 44 of the upper frame section 34. The leg rest panels 76 are sufficiently sized to allow the disabled person 32 to rest their calves thereagainst and when used in conjunction with the front wheel plate 72, provide a comfortable support system for the legs and the feet. A third cross connector tube 78 connects the two front portions 44 together. A lower end 80 supporting each leg rest panel 76 is attached to the upper portion of the third cross connector tube 78 and to the respective front portion 40.

As best illustrated in FIG. 2, the lower frame section 36 is generally H-shaped and includes two tubular central sections 82 that are located substantially adjacent and spaced apart from each other along a respective edge portion 84 thereof. The tubular sections 82 are spread apart at their respective front 86 and rear ends 88, the front ends 86 being connected to the respective front wheel plate 72 and the rear ends 86 being connected to a respective rear wheel plate 90. The central sections 82 are separatable along a horizontal plane as will be described below. A rear end connector tube 91 is connected across the spread apart rear ends 88 of the central sections 82. The rear end connector tube 91 is also connected to the rear wheel plates 90.

Figure 5:
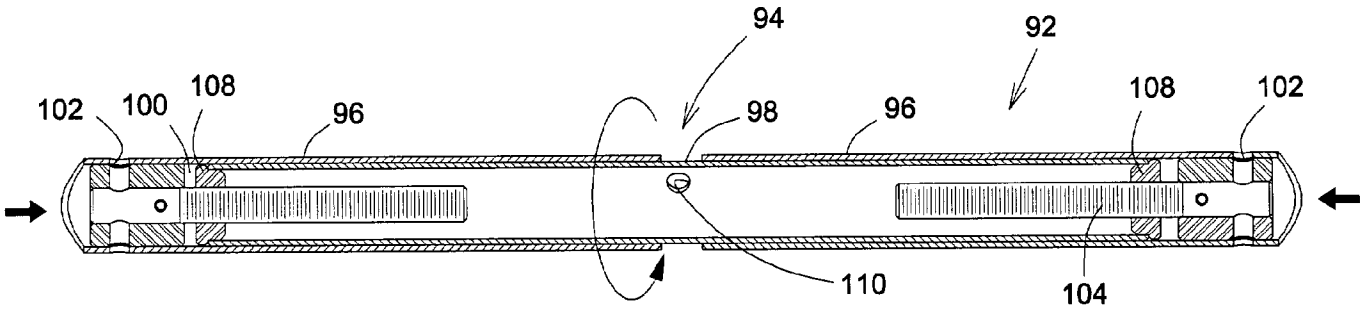
FIG. 5 is a cross section view of a width adjuster in retracted configuration.
Figure 6:
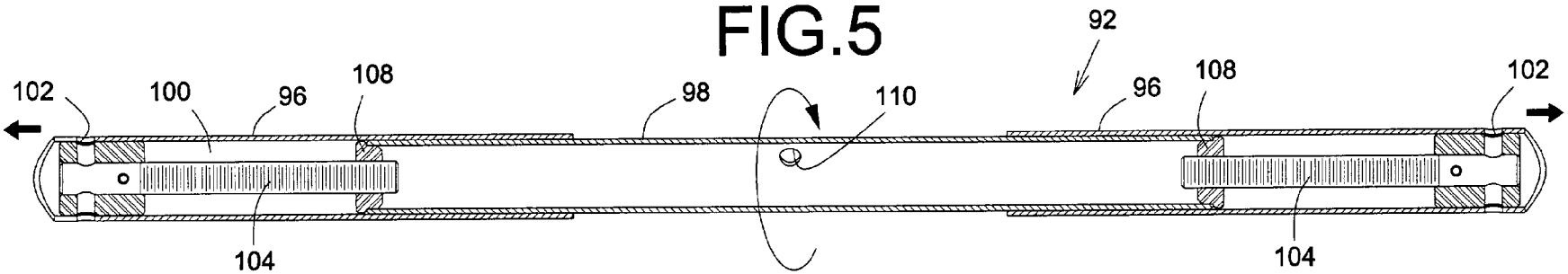
FIG. 6 is a cross section view of the width adjuster of FIG. 5 in an extended configuration.

Referring to FIGS. 2, 5, and 6, the connector tubes 46, 48, 78, 91 each have width adjustment members 92 that are located in a central portion 94 of each of the connector tubes 46, 48, 78, 91. The width adjustment members 92 allow the user to increase or decrease the width of the auxiliary frame 10 to accommodate primary wheelchairs of different sizes. The width adjustment members 92 include two separable tube portions 96 and an adjuster rod 98 that is mounted in an axial adjuster bore 100 and acts as a releasable lock. Each separable tube 96 includes a hollow end 102 to which a threaded guide shaft 104 is secured. The threaded guide shaft 104 is located centrally of the axial adjuster bore 100 and allows the adjuster rod 98 to axially move up and down the threaded guide shaft 104. A nut 108 is attached to the adjuster rod 98 and engages the threaded guide shaft 104 to allow it to rotate in the directions of the arrow in FIGS. 5 and 6. Obviously, the two opposed threaded guide shafts 104 respectively have left and right threads such that the two opposed separable tube portions 96 simultaneously moves in opposite directions relative to the adjuster rod 98 upon rotation thereof so as to move toward and away from each other, as shown in FIGS. 5 and 6 respectively. When required, the user can locate a key or the like into a hole 110 located generally radially in the adjuster rod 98 to rotate the rod 98. When there is sufficient clearance between the separable tube portions 96, the user can rotate the rod 98 by hand until the required width is obtained. The tubular central sections 82 being interconnected with the rear end connector tube 91 will separate along the edge portion 84 when the separable tube portions 96 of the rear end connector tube 91, with 46, 48 and 78, moves apart to create a gap therebetween (not shown).

Referring now to FIGS. 2, 3*a*, 3*b*, 4*a* and 4*b*, the front wheel plate 72 and the rear wheel plate 90 have the respective front and rear wheels 26, 28 connected thereto. The front wheels 26 are pivotally connected to a lower portion 112 of the front wheel plates 72 and allow for axial and steerable movement of the front wheels 26, such as conventional castor wheels. The rear wheels plates 90 are generally V-shaped and include an outer face 114 to which the rear wheels 28 are connected. The rears wheels 28 are angled away from a vertical plane and the rear end section and provide a wide and stable wheelbase during disengagement of the auxiliary wheelchair 10 from the primary wheelchair 12. The rear wheels 28 each include a bar 116 which is hingeably connected to a generally plate panel 118 about a substantially horizontal axis. The bar 116 includes a bar hole 120 located at one end for engaging a floor anchoring piece 122.

A cable 124 is connected to the other end of the bar 116 while the cable sleeve 124' is secured to an extension plate 90' of the rear wheel plate 90. The cable 124 allows the bar 116 to engage or disengage the floor anchoring piece 122 if the user requires more stability adjacent, for example, a bathtub or the like once the auxiliary wheelchair 10 is away from the primary wheelchair 12. At the other end of the cable 124, the cable 124 is connected to, via a spring 125, the lower end 62 of each of the first longitudinal body portions 64 of the frame section connector 38, while the cable sleeve 124' is connected to the respective actuator 30 that is fixed relative to the second longitudinal body portion 66 of the frame section connector 38. The springs 125 operates to take up any difference (L1–L2 of FIGS. 3*a* and 3*b*) in the displacements occurring at the two ends of each cable 124 during movement of the frame section connectors 38 when the actuators 30 are operated, without restraining or opposing to the displacement of the cable 124.

Figure 3B:
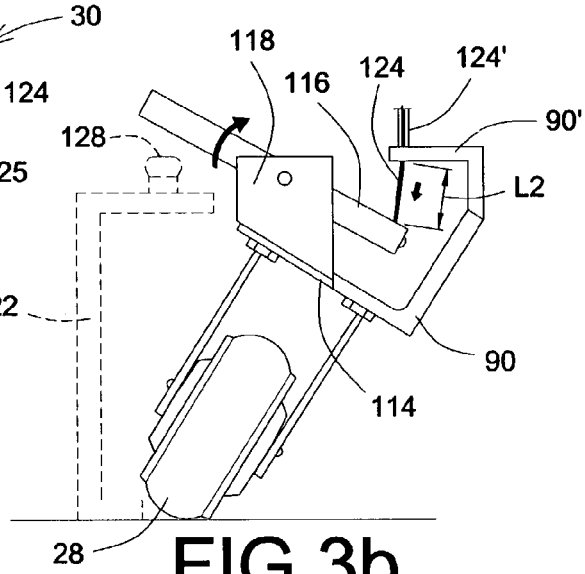
FIG. 3*b* is a partial rear view of a floor anchoring piece disengaged from the auxiliary frame.
Figure 4B:
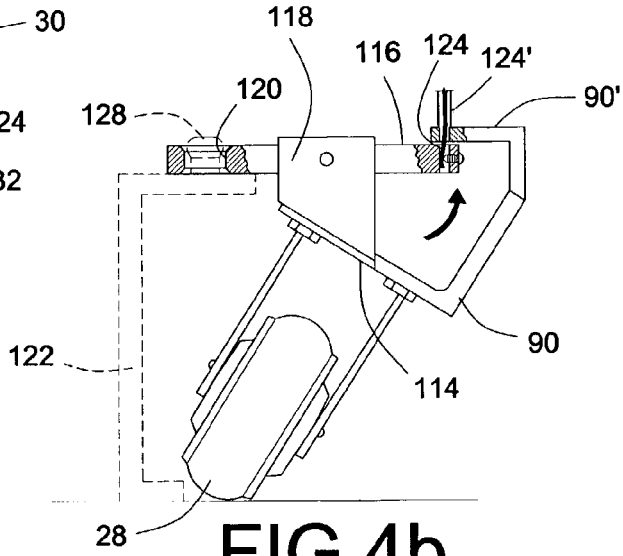
FIG. 4*b* is a partial rear view of the floor anchoring piece of FIG. 3*b* engaged from the auxiliary frame.

In operation, when the upper frame section 34 is moved up relative to the lower frame section 36 by a displacement L1 shown in FIG. 3*a*, each cable 124 retracts into the sleeve 124' at one end under the compression of the spring 125 (see FIG. 3*a*) and extracts out of the sleeve 124' at the other end with a displacement L2 shown in FIG. 3*b* to disengage the bar 116 from the floor anchoring piece 122, or a similar anchoring device on the primary wheelchair 12. The cable 124 is typically rigid enough to be able to make the bar 116 to pivot into the anchoring disengagement position. On the opposite, when the upper frame section 34 is moved down relative to the lower frame section 36, by the same displacement L1, as shown in FIG. 4*a*, each cable 124 extracts out from the sleeve 124' at one end with a displacement L2 under the tension of the spring 125 (see FIG. 4*a*) and retracts into the sleeve 124 at the other end with the same displacement L2 to engage the bar 116 into the floor anchoring piece 122 as shown in FIG. 4*b* so as to anchor the auxiliary wheelchair 10 to the adjacent floor or the like.

Although not shown, a biasing means such as a tension spring could obviously be installed between the end of bar 116 connected to the cable 124 and the rear wheel plate 90 to bias the bar 116 towards the rear wheel plate 90 in the position shown in FIG. 3*b* without departing from the scope of the present invention. In such a case, the biasing means would obviously need to have a biasing force smaller than the tension force of spring 125 in order to ensure the cable 124 is maintained in the position depicted in FIGS. 4*a* and 4*b* by the spring 125.

Figure 7:
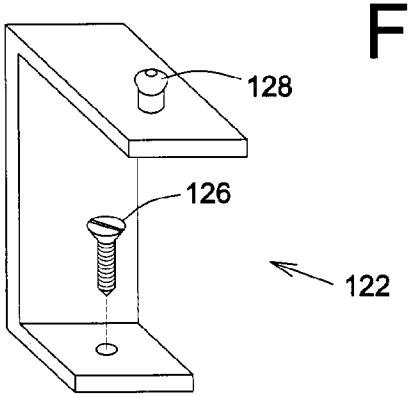
FIG. 7 is a perspective view of the floor anchoring piece of FIG. 4*b;*

As shown in FIG. 7, the floor anchoring piece 122 includes an anchoring means 126 such as a screw fastener or the like and a guiding projection 128 for engagement with the bar hole 120.

Figure 8:
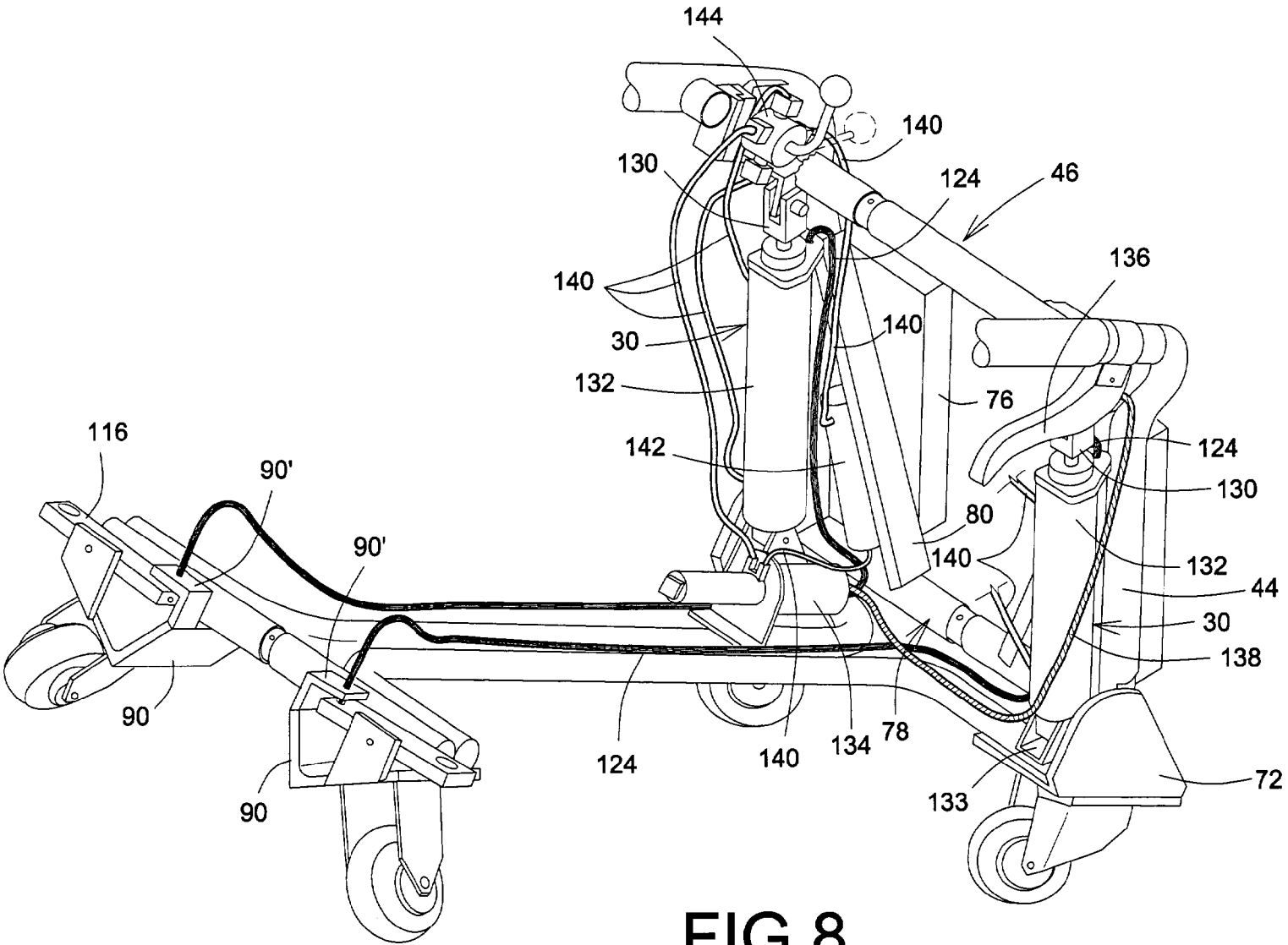
FIG. 8 is a perspective view of a hydraulic system of the auxiliary wheelchair of FIG. 1.
Figure 9:
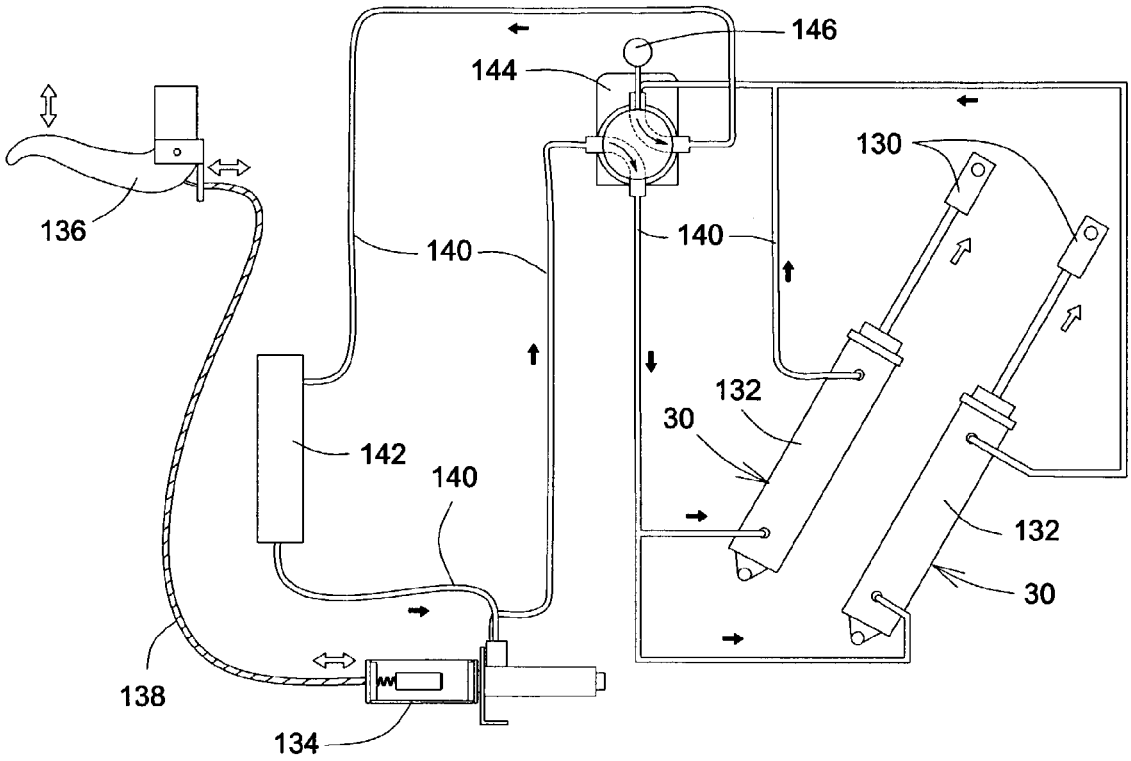
FIG. 9 is a simplified representation of the hydraulic system with an extended hydraulic actuator.
Figure 10:
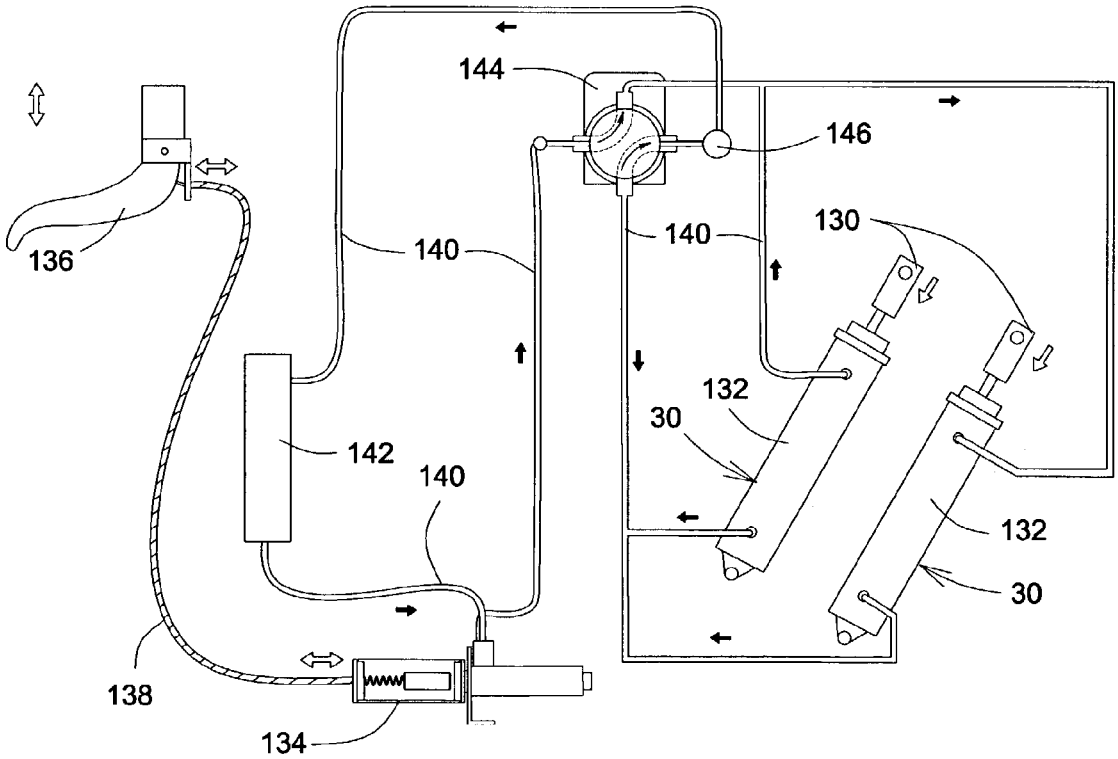
FIG. 10 is a simplified representation of the hydraulic system of FIG. 9 with a retracted actuator.

Referring now to FIGS. 8, 9 and 10, each of the two hand-operated actuators 30 includes a piston rod 130 and its cylinder 132 pivotally mounted on the first and second longitudinal body portions 64, 66 using brackets 131 (see FIG. 3*a*) and 133 respectively. In this embodiment, the actuators 30 are simultaneously hand-operated via a hydraulic pump 134 mounted on one of the two tubular sections 82. The pump 134 is connected to a handle 136 via an actuator cable 138, mounted on the horizontal portion 42 of one of the side section 40 (preferably opposite to the pump 134) adjacent the intermediate portion 60 and operated by the user of the auxiliary wheelchair 1 0. The actuator cable 138 is connected to the handle 136 and to the pump 134 and operates the hydraulic actuators 30 through a network of conduits 140, which interconnects the pump 134, the hydraulic actuators 30, a fluid reservoir 142, and a four-way, two position control valve 144. The valve 144, preferably mounted on the horizontal portion 42 of preferably the same side section 40 corresponding to the pump 134, includes a two position lever arm 146 operable by the user.

When the user moves the lever arm 146 in the up position, as shown in FIGS. 8 and 9, and activates the handle 136 with a pumping action, the hydraulic fluid, typically either conventional soap or the like non-damageable and environment friendly fluid, moves in the direction of the arrows to extract the piston rods 130 out from their respective hydraulic cylinder 132 so as to raise the upper frame section 34 away from the lower frame section 36. Alternatively, when the valve lever arm 146 is moved in the forward position, as shown in dotted lines in FIG. 8 and in FIG. 10, the pumping action of the handle 136 causes the pump 130 to direct the hydraulic fluid in the opposite direction to retract the piston rods 130 into their respective hydraulic cylinder 132, so as to lower the upper frame section 34 closer to the lower frame section 36.

Operation

Figure 11:
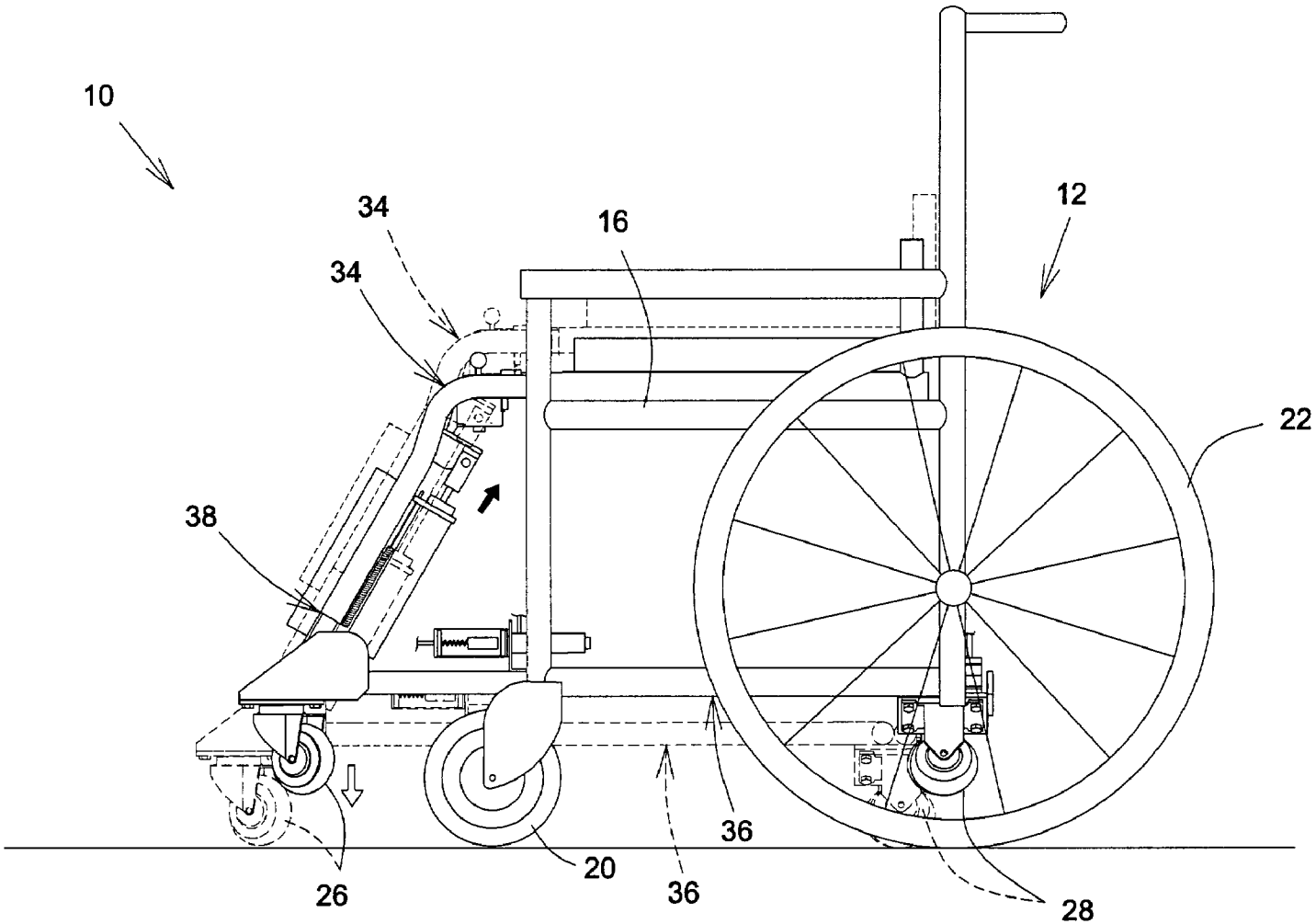
FIG. 11 is a side view of the auxiliary wheelchair of FIG. 1, showing three configurations of the auxiliary wheelchair relative to the primary wheelchair, a first support configuration in solid lines, a second support configuration in long dashed lines, and a third support configuration in short dashed lines.
Figure 12:
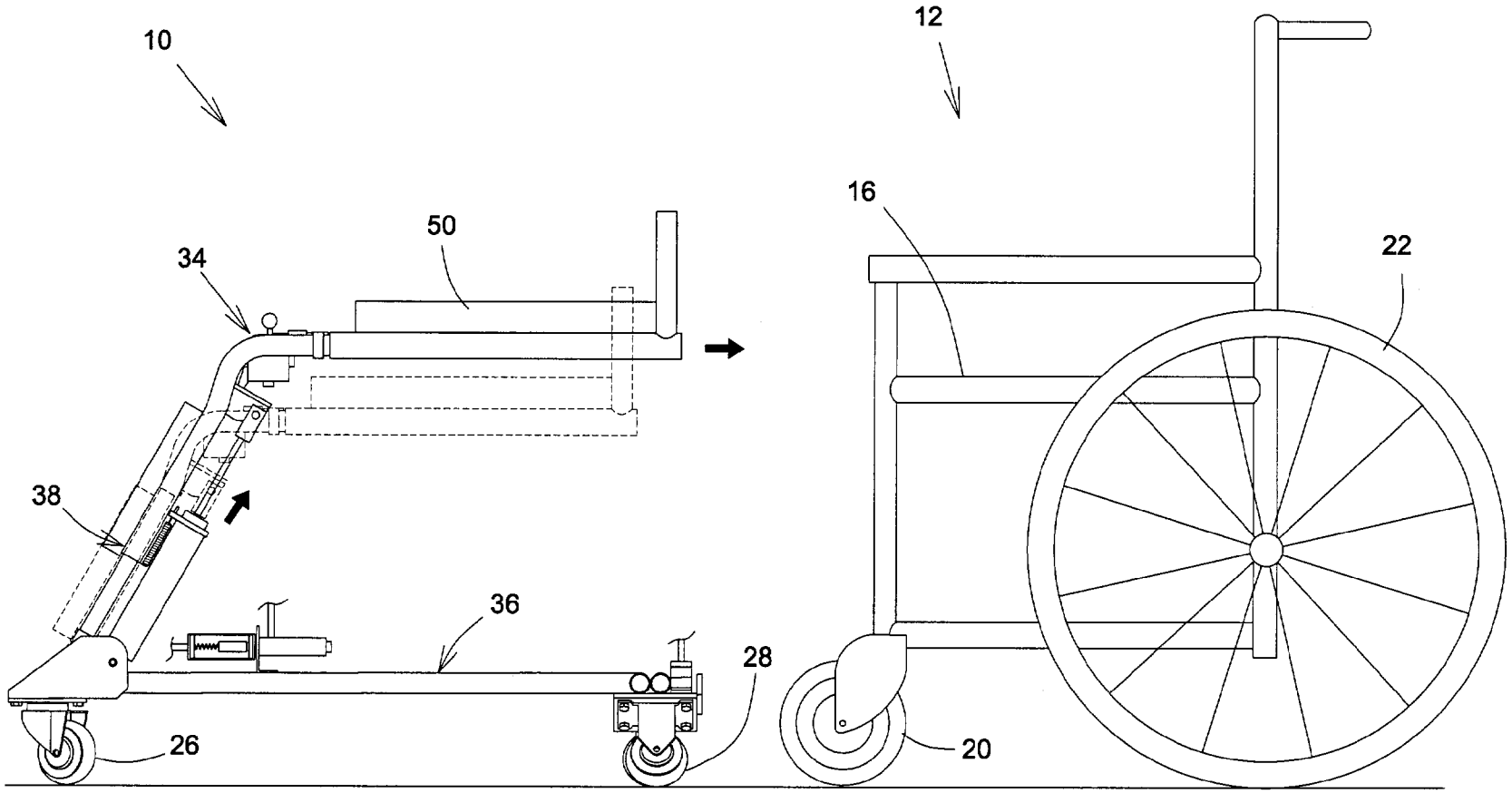
FIG. 12 is a side view of the auxiliary wheelchair of FIG. 1 removed from the primary wheelchair.

Referring now to FIGS. 1, 11 and 12, the auxiliary wheelchair 10 is normally operated from a default or first support configuration as shown in FIG. 1 and in solid lines in FIG. 11. In the first support configuration, the primary wheelchair seat 16 supports the upper frame section 34 and is spaced apart from the lower frame section 36 and the lower frame section 36 is positioned off the ground, retracted toward the upper frame section 34, such that only the primary wheelchair wheels 20, 22 are in contact with the ground surface. When the user is near the location where he or she wishes to move the auxiliary wheelchair 10 away from the primary wheelchair 12, the user ensures that the valve lever arm 146 is positioned upwardly and activates the handle 136. This operation actuates, via the actuators 30 connected to the telescoping frame connectors 38, the lower frame section 36 away from the upper frame section 34 while disengaging the bars 116 from the guiding projection (not shown) of the primary wheelchair if applicable, with the auxiliary wheelchair 10 from the first support configuration to a second support configuration shown in long dashed lines in FIG. 11. The lower frame section 36, in the second support configuration, rests on and is supported by the ground. In this second support configuration, the primary wheelchair seat 16 also still partially supports the upper frame section 34. To move the upper frame section 34 away from the primary wheelchair seat 16 into a third support configuration of the auxiliary wheelchair 10 shown in short dashed lines in FIG. 11, the user further activates the handle 136. The upper frame section 34 is then actuated away from the primary wheelchair seat 16 and further spaced apart from the lower frame section 36 to allow the auxiliary wheelchair 10 to move away from the primary wheelchair 12, with the wheels 26, 28 of the auxiliary wheelchair 10 being in full contact with the ground and entirely supporting the weight of the auxiliary wheelchair 10 and its user, as shown in FIG. 13. To re-position the auxiliary wheelchair 10 on the primary wheelchair 12, the above procedure is reversed as shown in FIG. 12, with the valve lever arm 146 in the forward position illustrated in FIG. 8 in dotted lines.

Alternatives

Although not shown, the auxiliary wheelchair 10 could easily be adapted for accommodation to use with electrically driven wheelchairs, or the like.

Similarly, the hand-operated actuators 30 and its hydraulic system could be replaced by electric-type actuators or the like without departing from the scope of the present invention.

Although the present auxiliary wheelchair has been described with a certain degree of particularity and details, it is to be understood that the disclosure has been made by way of example only and that the present invention is not limited to the features of the embodiments described and illustrated herein, but includes all variations and modifications within the scope and spirit of the invention hereinafter claimed.

I claim:

1. An auxiliary wheelchair for disposing on a primary wheelchair, said auxiliary wheelchair comprising:

first and second frame sections;

frame section connector for telescopically movably connecting said first frame section and said second frame section relative to one another longitudinally along a connecting axis therefor, said second frame section being actuatable for longitudinal movement along said connecting axis relative to said first frame section from a first support configuration to a second support configuration;

said first support configuration being when said first frame section is in contact engagement with a primary wheelchair seat to support said first and second frame sections and said second frame section is entirely spaced apart from said primary wheelchair seat and a support surface;

said second support configuration being when said second frame section is in contact engagement with said support surface and said first frame section is in contact engagement with said primary wheelchair seat so that said auxiliary wheelchair is supported by said primary wheelchair seat and said support surface.

2. The auxiliary wheelchair, according to claim 1, in which:

said second frame section is actuatable for longitudinal movement along said connecting axis relative to said first frame section from said second support configuration to a third support configuration;

said support configuration being when said first frame section is spaced apart from said primary wheelchair seat, and said support surface supports said first and second frame sections.

3. The auxiliary wheelchair, according to claim 1, in which said first frame section includes two side sections movably connected to each other.

4. The auxiliary wheelchair, according to claim 3, in which each side section includes:

a generally horizontal upper portion;

a front portion; and an intermediate portion interconnecting said upper portion and said front portion.

5. The auxiliary wheelchair, according to claim 4, in which said front portion includes a first and second longitudinal body portions, said first longitudinal body portion having a bore extending longitudinally axially along said connecting axis therein and sized to longitudinally axially and slidably receive said second longitudinal body portion therein.

6. The auxiliary wheelchair, according to claim 5, in which said second longitudinal body portion is connected to a front wheel plate and extends longitudinally upwardly therefrom along said connecting axis towards said first longitudinal body portion, said front wheel plate being connected to said second frame section.

7. The auxiliary wheelchair, according to claim 6, in which said second frame section includes:

first and second central sections substantially adjacent to each other and extending along an edge thereof, each of said central sections being spread apart at a front and rear end section; and a rear end connector section connected to each rear end section of said central section.

8. The auxiliary wheelchair, according to claim 7, in which a rear wheel plate is connected to said rear end section and said front wheel plate is connected to said front end section.

9. The auxiliary wheelchair, according to claim 8, in which a steerable wheel is attached to each of said front wheel plate.

10. The auxiliary wheelchair, according to claim 5, in which an actuator is connected to each of said first and second longitudinal body portions for longitudinally axially displacing said second longitudinal body portion along said connecting axis relative to said first longitudinal body portion within said axial bore.

11. The auxiliary wheelchair, according to claim 10, in which said actuator is a hand-operated hydraulic actuator.

12. The auxiliary wheelchair, according to claim 8, in which said rear wheel plate is a generally V-shaped plate having a plate outer face.

13. The auxiliary wheelchair, according to claim 12, in which a rear wheel is attached to said V-shaped plate outer face for rotation relative thereto, said rear wheel being angled laterally away from said rear end section.

14. The auxiliary wheelchair, according to claim 4, in which each side section includes first and second connectors connected to said upper portions, said first and second connectors defining a seating section therebetween.

15. The auxiliary wheelchair, according to claim 14, in which each side section further includes a third connector connected to said front portion.

16. The auxiliary wheelchair, according to claim 15, in which said first, second and third connectors each includes a width adjustment member for increasing or decreasing the width of said auxiliary wheelchair so as to accommodate primary wheelchairs of different sizes.

17. The auxiliary wheelchair, according to claim 16, in which said width adjustment member comprises:

a separable tube portion located in each of said connectors; and an adjuster rod slidably axially mounted in each of said separatable tube portions to allow said separatable tube portions to move axially towards and away from each other.

18. The auxiliary wheelchair, according to claim 17, in which said width adjuster member is located centrally in each of said first, second and third connectors.

19. The auxiliary wheelchair, according to claim 18, in which said width adjuster member is releasably lockable.

20. The auxiliary wheelchair, according to claim 14, in which said seating section includes a plurality of spaced apart support panels each having a panel end connected respectively to said first and second connectors.

21. The auxiliary wheelchair, according to claim 20, in which said seating section is sized to receive a cushion thereon.

22. A wheelchair, comprising:

a primary wheelchair seat for releasably supporting thereon an auxiliary wheelchair, said auxiliary wheelchair having first and second frame sections;

frame section connector for telescopically movably connecting said first frame section and said second frame section relative to one another longitudinally along a connecting axis therefor, said second frame section being actuatable for longitudinal movement along said connecting axis relative to said first frame section from a first support configuration to a second support configuration;

said first support configuration being when said first frame section is in contact engagement with said primary wheelchair seat to support said first and second frame sections and said second frame section is entirely spaced apart from said primary wheelchair seat and a support surface;

said second support configuration being when said second frame section is in contact engagement with said support surface and said first frame section is in contact engagement with said primary wheelchair seat so that said auxiliary wheelchair is supported by said primary wheelchair seat and said support surface.

23. The wheelchair, according to claim 22, in which:

said second frame section is actuatable for longitudinal movement along said connecting axis relative to said first frame section from said second support configuration to a third support configuration;

said third support configuration being when said first frame section is spaced apart from said primary wheelchair seat, and said support surface supports said first and second frame sections.

24. The wheelchair, according to claim 22, in which said first frame section includes two side sections movably connected to each other.

25. The wheelchair, according to claim 24, in which each side section includes:

a generally horizontal upper portion;

a front portion; and an intermediate portion interconnecting said upper portion and said front portion.

26. The wheelchair, according to claim 25, in which said front portion includes a first and second longitudinal body portions, said first longitudinal body portion having a bore extending longitudinally axially along said connecting axis therein and sized to longitudinally axially and slidably receive said second longitudinal body portion therein.

27. The wheelchair, according to claim 26, in which said second longitudinal body portion is connected to a front wheel plate and extends longitudinally upwardly therefrom along said connecting axis towards said first longitudinal body portion, said front wheel plate being connected to said second frame section.

28. The wheelchair, according to claim 27, in which said second frame section includes:

first and second central sections substantially adjacent to each other and extending along an edge thereof, each of said central sections being spread apart at a front and rear end section; and a rear end connector section connected to each rear end section of said central section.

29. The wheelchair, according to claim 28, in which a rear wheel plate is connected to said rear end section and said front wheel plate is connected to said front end section.

30. The wheelchair, according to claim 29, in which a steerable wheel is attached to each of said front wheel plate.

31. The wheelchair, according to claim 30, in which said rear wheel plate is a generally V-shaped plate having a plate outer face.

32. The wheelchair, according to claim 31, in which a rear wheel is attached to said V-shaped plate outer face for rotation relative thereto, said rear wheel being angled laterally away from said rear end section.

33. The wheelchair, according to claim 27, in which an actuator is connected to each of said first and second longitudinal body portions for longitudinally axially displacing said second longitudinal body portion along said connecting axis relative to said first longitudinal body portion within said axial bore.

34. The wheelchair, according to claim 33, in which said actuator is a hand-operated hydraulic actuator.

35. The wheelchair, according to claim 25, in which each side section includes first and second connectors connected to said upper portions, said first and second connectors defining a seating section therebetween.

36. The wheelchair, according to claim 35, in which each side section further includes a third connector connected to said front portion.

37. The wheelchair, according to claims 36, in which said first, second and third connectors each includes a width adjustment member for increasing or decreasing the width of said auxiliary wheelchair so as to accommodate primary wheelchairs of different sizes.

38. The wheelchair, according to claim 37, in which said width adjustment member comprises:

a separable tube portion located in each of said connectors; and an adjuster rod slidably axially mounted in each of said separatable tube portions to allow said separatable tube portions to move axially towards and away from each other.

39. The wheelchair, according to claim 38, in which said width adjuster member is located centrally in each of said first, second and third connectors.

40. The wheelchair, according to claim 39, in which said width adjuster member is releasably lockable.

41. The wheelchair, according to claim 35, in which said seating section includes a plurality of spaced apart support panels each having a panel end connected respectively to said first and second connectors.

42. The wheelchair, according to claim 41, in which said seating section is sized to receive a cushion thereon.

* * * * *